US011440756B2

(12) United States Patent
Tsuda

(10) Patent No.: US 11,440,756 B2
(45) Date of Patent: Sep. 13, 2022

(54) SHEET FEEDING APPARATUS AND IMAGE FORMING APPARATUS

(71) Applicant: CANON KABUSHIKI KAISHA, Tokyo (JP)

(72) Inventor: Satoshi Tsuda, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/023,135

(22) Filed: Sep. 16, 2020

(65) Prior Publication Data

US 2021/0094775 A1 Apr. 1, 2021

(30) Foreign Application Priority Data

Sep. 27, 2019 (JP) ..... JP2019-178028

(51) Int. Cl.
*B65H 3/06* (2006.01)

(52) U.S. Cl.
CPC ..... *B65H 3/0676* (2013.01); *B65H 3/0669* (2013.01); *B65H 3/0684* (2013.01)

(58) Field of Classification Search
CPC ..... B65H 3/06; B65H 3/0669; B65H 3/0676; B65H 3/0684
See application file for complete search history.

(56) References Cited

U.S. PATENT DOCUMENTS

| | | | | |
|---|---|---|---|---|
| 7,025,345 | B2 * | 4/2006 | Frazier | B65H 3/06 271/109 |
| 2009/0108514 | A1 * | 4/2009 | Lee | B65H 3/0669 271/10.1 |
| 2010/0194030 | A1 * | 8/2010 | Okamoto | B65H 5/062 271/10.11 |
| 2018/0148285 | A1 * | 5/2018 | Suzuki | B65H 3/0684 |

FOREIGN PATENT DOCUMENTS

| | | | |
|---|---|---|---|
| JP | 2000-233838 | * | 8/2000 |
| JP | 2017-065865 | A | 4/2017 |
| JP | 2017-121990 | A | 7/2017 |
| JP | 2017-197383 | A | 11/2017 |
| JP | 2018-016458 | A | 2/2018 |

* cited by examiner

*Primary Examiner* — Thomas A Morrison
(74) *Attorney, Agent, or Firm* — Canon U.S.A., Inc. I.P. Division

(57) ABSTRACT

A conveyance rotating body is rotatably supported by a support member. A second rotational axis at a rotation center of a driven transmission member is disposed at a position different from a position of a first rotational axis. When a feeding unit is attached to a sheet feeding apparatus, a drive transmission member and the driven transmission member engage with each other. When a driving force is transmitted from the drive transmission member to the driven transmission member, the feeding unit receives a force in an attachment direction of the feeding unit and is positioned with respect to the sheet feeding apparatus.

14 Claims, 11 Drawing Sheets

SHEET FEEDING APPARATUS AND IMAGE FORMING APPARATUS

BACKGROUND

Field of the Disclosure

The present disclosure generally relates to a sheet feeding apparatus having a detachable unit, and an image forming apparatus.

Description of the Related Art

Image forming apparatuses, such as copiers and printers, include a sheet feeding apparatus that conveys a sheet from a storage unit. The sheet feeding apparatus includes a feeding unit that conveys a sheet toward an image forming unit, and the feeding unit is configured as a unit detachable from the sheet feeding apparatus.

The feeding unit includes a conveyance rotating body having a friction portion made of, for example, rubber. When a sheet is conveyed, the conveyance rotating body comes in contact with the sheet and rotates to convey the sheet to the image forming unit.

In a case where the rubber of the conveyance rotating body has been deteriorated by friction, the feeding performance can be degraded. Therefore, the feeding unit may be replaced with a new one by a user or a service engineer.

Japanese Patent Application Laid-Open No. 2017-121990 discusses a configuration for making a feeding unit replaceable.

However, in the configuration discussed in Japanese Patent Application Laid-Open No. 2017-121990, handling of the feeding unit which is a detachable unit may be complicated when the feeding unit is detached for replacement and a new feeding unit is attached.

SUMMARY

According to an aspect of the present disclosure, a sheet feeding apparatus for feeding a sheet includes a storage unit, having a stacking member, configured to store sheets stacked on the stacking member, a feeding unit, attachable to and detachable from the sheet feeding apparatus, configured to feed the sheets stacked on the stacking member, a separation unit configured to separate one by one the sheets fed by the feeding unit, and a drive transmission member configured to rotate about a first rotational axis, wherein the feeding unit includes a driven transmission member configured to engage with the drive transmission member to receive a driving force from the drive transmission member in a state where the feeding unit is attached to the sheet feeding apparatus, a conveyance rotating body configured to convey a sheet, the conveyance rotating body rotating by the driven transmission member receiving the driving force and rotating, and a support member configured to support the driven transmission member and the conveyance rotating body, wherein the conveyance rotating body is rotatably supported by the support member, and a second rotational axis at a rotation center of the driven transmission member is disposed at a position different from a position of the first rotational axis, wherein, when the feeding unit is attached to the sheet feeding apparatus, the drive transmission member engages with the driven transmission member, and wherein, when the driving force is transmitted from the drive transmission member to the driven transmission member, the feeding unit receives a force in an attachment direction of the feeding unit and is positioned with respect to the sheet feeding apparatus.

Further features of the present disclosure will become apparent from the following description of exemplary embodiments with reference to the attached drawings.

DESCRIPTION OF THE EMBODIMENTS

Exemplary embodiments of the present disclosure will be described below with reference to the accompanying drawings.

Figure 1:
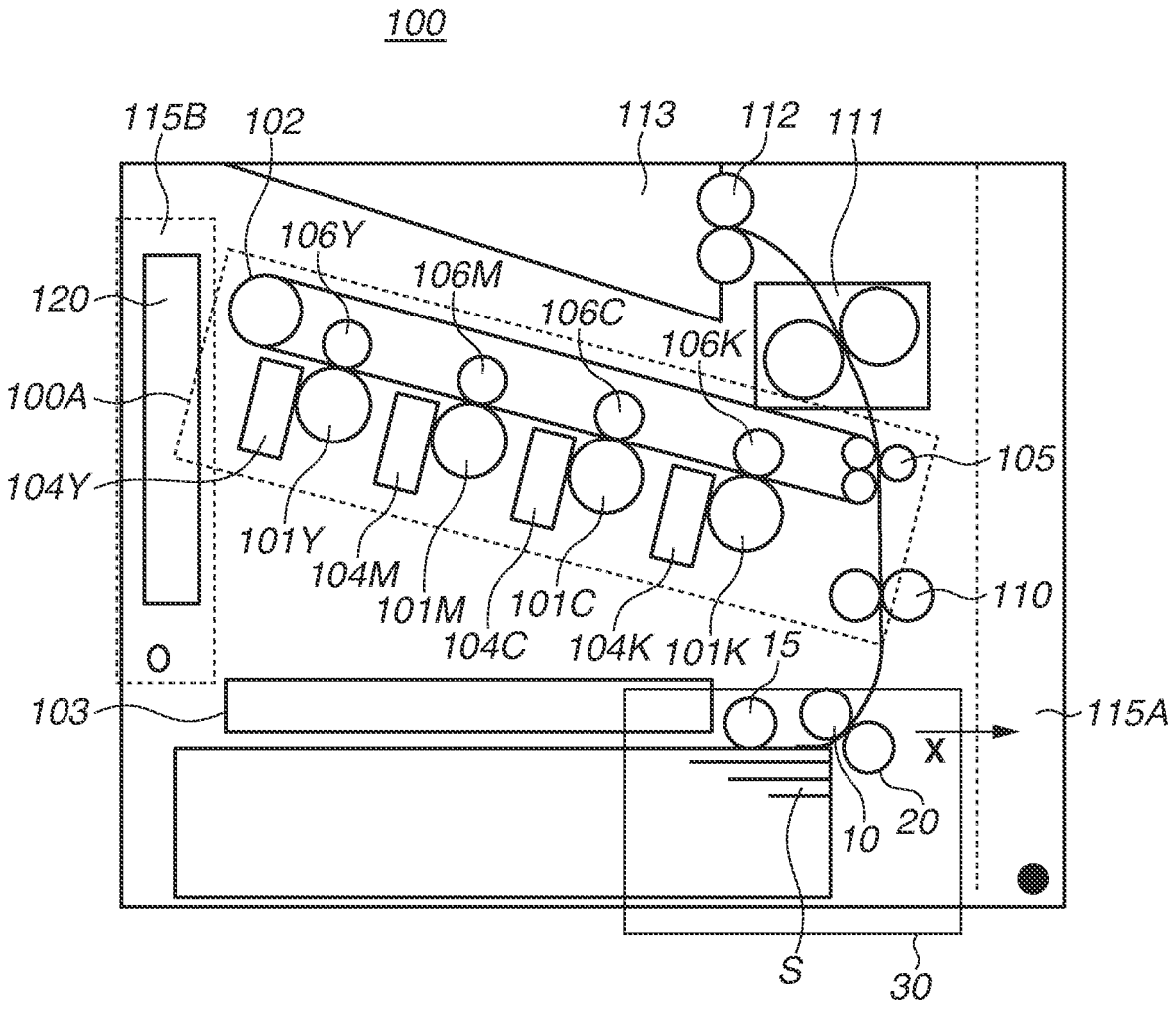
FIG. 1 schematically illustrates a sheet feeding apparatus and an image forming apparatus.

FIG. 1 schematically illustrates a sheet feeding apparatus and an image forming apparatus according to a first exemplary embodiment. As the image forming apparatus, an electrophotographic color laser beam printer (hereinafter referred to as a printer 100) will be taken as an example and described below with reference to the accompanying drawings. While the printer 100 employs an electrophotographic method, the present disclosure is not limited thereto but applicable to an inkjet method.

While, in the present exemplary embodiment, apart of the printer 100 configures a sheet feeding apparatus 30 for feeding a sheet, other configurations are also applicable. For example, a feeding deck that is connected to the printer 100 as an optional apparatus may be used as a sheet feeding apparatus. While, in the present exemplary embodiment, a feeding unit will be described as an example of a replaceable unit, the present disclosure is not limited thereto but applicable to a unit detachably attached to the printer 100.

As illustrated in FIG. 1, the printer 100 includes an image forming unit 100A and a sheet feeding apparatus 30. The image forming unit 100A includes four photosensitive drums 101Y, 101M, 101C, and 101K for forming toner images of four colors (yellow, magenta, cyan, and black), respectively. The image forming unit 100A further includes an endless intermediate transfer belt 102 that is in contact with the four photosensitive drums. The toner images formed on the four photosensitive drums 101Y, 101M, 101C, and 101K are primarily transferred to the intermediate transfer belt 102. The image forming unit 100A further includes primary transfer rollers 106Y, 106M, 106C, and 106K that press the photosensitive drums 101Y, 101M, 101C, and 101K, respectively, from the inner surface of the intermediate transfer belt 102. A transfer voltage is applied to the primary transfer rollers 106Y, 106M, 106C, and 106K from a transfer power source (not illustrated), and a potential difference is generated between each of the photosensitive drums 101Y, 101M, 101C, and 101K and the intermediate transfer belt 102. The potential difference causes toner images to be primarily transferred from the photosensitive drums 101Y, 101M, 101C, and 101K to the intermediate transfer belt 102. The image forming unit 100A further includes a secondary transfer roller 105 that secondarily transfers the images transferred to the intermediate transfer belt 102 to the sheet S.

When the image forming unit 100A starts an image forming operation, the photosensitive drums 101Y, 101M, 101C, and 101K, each of which is charged to a fixed potential, are irradiated with light corresponding to an image signal by a laser scanner 103. As a result, electrostatic latent images are formed on the photosensitive drums 101Y, 101M, 101C, and 101K.

When the electrostatic latent images are developed with the toner stored in development cartridges 104Y, 104M, 104C, and 104K, toner images (visible images) are formed on the photosensitive drums 101Y, 101M, 101C, and 101K, respectively. The toner images formed on the photosensitive drums 101Y, 101M, 101C, and 101K are primarily transferred to the intermediate transfer belt 102. The toner image formed on the intermediate transfer belt 102 are conveyed to a secondary transfer position by the intermediate transfer belt 102.

Sheets S are fed one by one from the sheet feeding apparatus 30 in parallel with the above-described toner image forming operation. A registration roller 110 for skew correction conveys a sheet S to a secondary transfer position formed by the nip between the intermediate transfer belt 102 and the secondary transfer roller 105. At this timing, to adjust the sheet conveyance direction position of the sheet S with the toner image formed on the intermediate transfer belt 102, conveyance speed of the sheet S is controlled by the registration roller 110 so that the timing of the sheet S for the toner image is adjusted. When the secondary transfer roller 105 is applied with a secondary transfer voltage at the secondary transfer position, the toner image is transferred from the intermediate transfer belt 102 to the sheet S.

The sheet S with the toner image transferred thereon is conveyed to a fixing unit 111. Then, the toner image is heated and pressurized by the fixing unit 111 to be fixed to the sheet S. The sheet S with the toner image fixed thereon is discharged to a discharge unit 113 at the upper part of the apparatus by a discharge roller 112.

The printer 100 has doors 115A and 115B which are openable open/close members. Opening the doors 115A and 115B exposes the inside of the printer 100. For example, when the door 115A is open and the inside of the printer 100 is exposed, a separation unit 20 (see FIGS. 2A and 2B) for separation described below and a feeding unit 10 (see FIGS. 2A and 2B) for sheet feeding described below are exposed, and therefore the user can detach the separation unit 20 and the feeding unit 10 in the direction X. The separation unit 20 and the feeding unit 10 are replaceable units that are detachable for replacement from the printer 100.

Residual toner remaining on the intermediate transfer belt 102 is removed by a cleaning unit (not illustrated) and then stored in a collected toner container 120. The collected toner container 120 is a replaceable unit that is replaceable for the printer 100 via the door 115B.

Figure 2A:
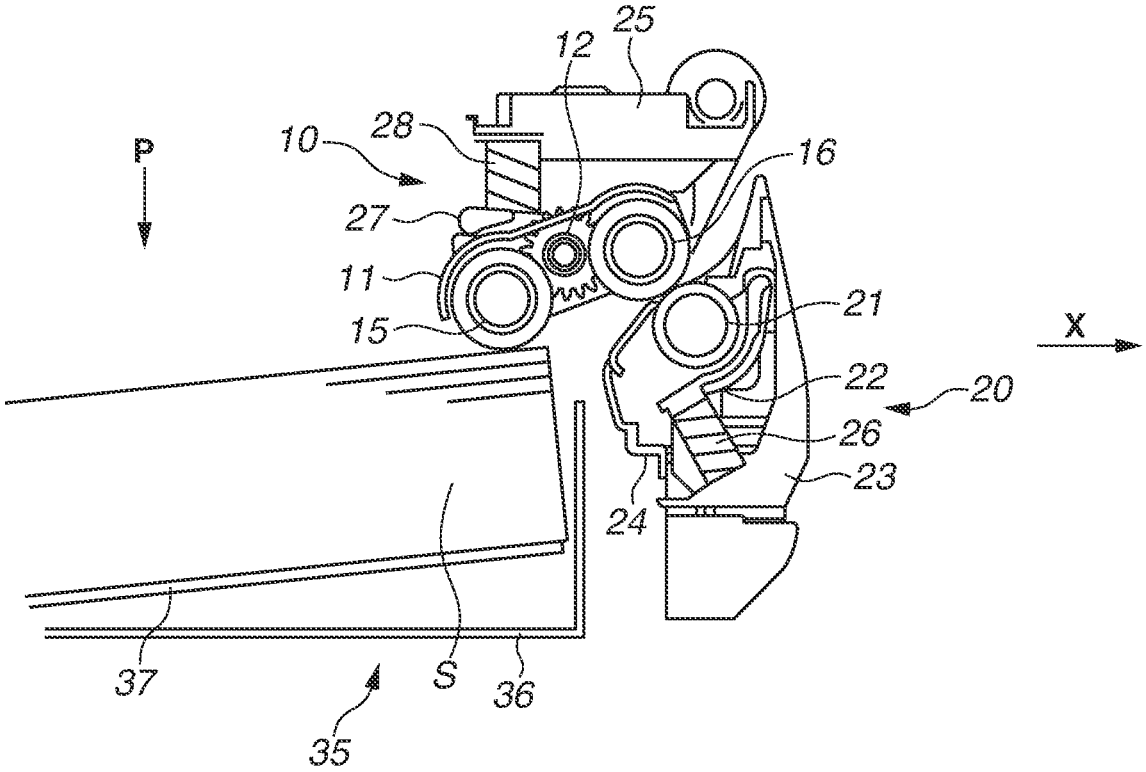
FIG. 2A is a cross-sectional view illustrating a state where a feeding unit is at a contact position.
Figure 2B:
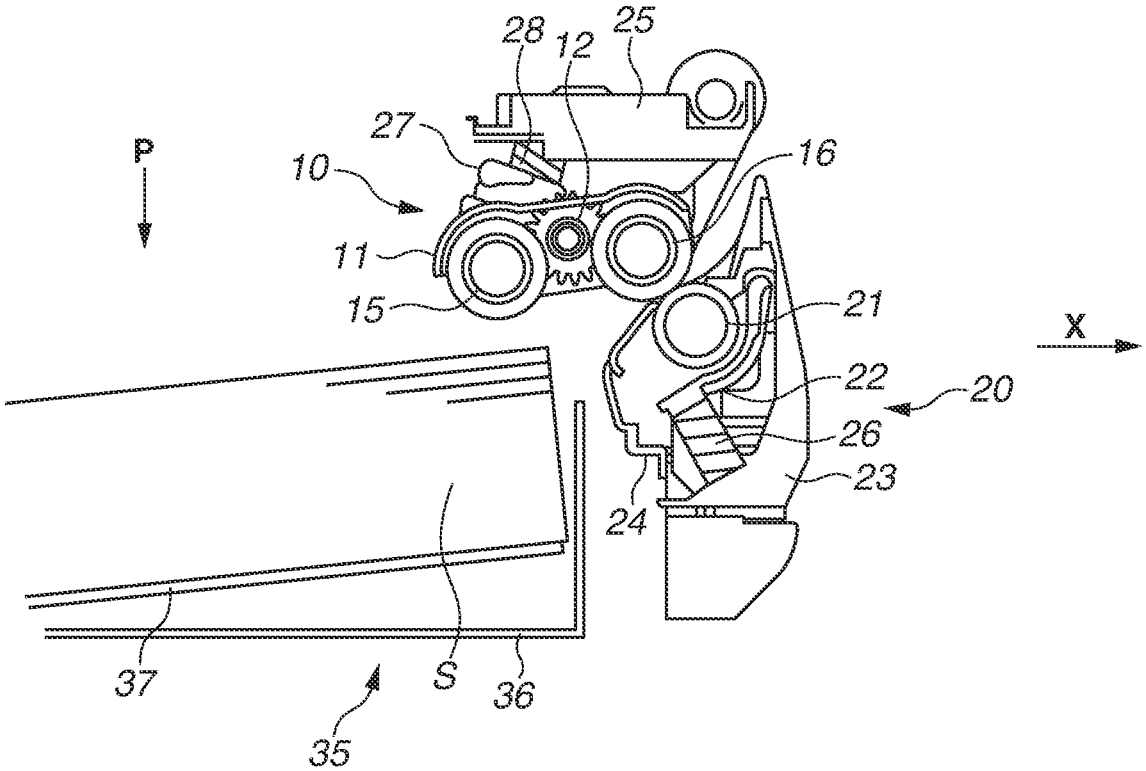
FIG. 2B is a cross-sectional view illustrating a state where the feeding unit is at a separated position.

The sheet feeding apparatus 30 according to the present exemplary embodiment will be described below with reference to FIGS. 1, 2 and 3. FIG. 2A illustrates a state where the feeding unit 10 is in the contact position, and FIG. 2B illustrates a state where the feeding unit 10 is in the separated position.

The sheet feeding apparatus 30 includes the feeding unit 10 as a feeding means, the separation unit 20 as a separation means, a sheet feeding drive unit (not illustrated), and a sheet storage drawer 35 as a storage unit detachable from the sheet feeding apparatus 30. The sheet storage drawer 35 includes a cassette tray 36 as a storage unit, and a stacking plate 37 as a stacking member on which sheets S are stacked. The stacking plate 37 is swingably disposed on the cassette tray 36.

As described above, the feeding unit 10 is detachable from the printer 100 and replaceable. The feeding unit 10 includes a roller holder 11 as a first support member, a pickup roller 15 as a feeding member, a feed roller 16 as a conveyance member, and an idler gear 12. The roller holder 11 rotatably supports the pickup roller 15 and the feed roller 16 as a conveyance member. The feeding unit 10 is detachable toward the downstream side (direction X) of the feeding support unit 25 disposed on the printer 100 in the conveyance direction.

In a state where the feeding unit 10 is attached to the feeding support unit 25, the feeding unit 10 is rotatably supported by the feeding support unit 25 to rotate about a rotational axis (second rotational axis) 16C of the feed roller 16. Further, the feeding unit 10 is biased in the direction P by a biasing spring 28 as a biasing member via a feeding pressure arm 27. In a feeding operation described below, the pickup roller 15 is in pressure contact with the sheet S on the stacking plate with a predetermined biasing force. The position of the feeding unit 10 in this state is referred to as a contact position.

In the present exemplary embodiment, the printer 100 includes a mechanism for separating the pickup roller 15 from the sheet S, as illustrated in FIG. 2B, when the feeding operation is not performed. This mechanism is intended to prevent a decrease in workability of attaching and detaching the feeding unit 10 and operability of the sheet storage drawer 35 due to the frictional resistance between the sheet S and the pickup roller 15. The position in a state in which the pickup roller 15 is separated from the sheet S is referred to as a separated position.

The separation unit 20 includes a separation roller 21 as a separation member, a separation roller holder 22 as a second support member, a separation base 23 as a base portion, a separation spring 26 as a biasing member, and a separation cover 24 engaged with the separation base 23 to cover the built-in members. The separation roller 21 includes a small-sized torque limiter for applying a brake with predetermined torque in the rotational direction. The separation unit 20 is attached to the sheet feeding apparatus 30 (forming a part of the printer 100 according to the present exemplary embodiment) in such a manner that the separation roller 21 is in the position facing the feed roller 16. The separation roller 21 is pressed to the feed roller 16 by the biasing force of the separation spring 26. The separation unit 20 is also supported to be detachable in the direction X with respect to the sheet feeding apparatus 30. According to the present exemplary embodiment, the separation unit 20 is detached before attaching or detaching the feeding unit 10 to/from the printer 100. Since this configuration enables the user to access the separation unit 20 and the feeding unit 10 from the same direction, workability is improved.

A feeding operation of the sheet feeding apparatus 30 will be described below. When the sheet storage drawer 35 is inserted into the sheet feeding apparatus 30, the stacking plate 37 rises, and the uppermost sheet S comes into contact with the pickup roller 15. At this timing, as described above, the pickup roller 15 receives the biasing force of the biasing spring 28 via the feeding pressure arm 27 and comes into contacts with the sheet S with a predetermined pressure.

Subsequently, the pickup roller 15 and the feed roller 16 receive a driving force from a sheet feeding drive unit (not illustrated) and rotate together in the counterclockwise direction illustrated in FIG. 2A. When the pickup roller 15 starts rotating, the sheet S starts moving rightward in FIG. 2A by the friction between the pickup roller 15 and the sheet S. Then, the sheet S reaches a separation nip portion formed by the feed roller 16 and the separation roller 21. The separation nip portion has a function of separating two or more sheets S sent to the separation nip portion by the pickup roller 15 and sending only one sheet S to the downstream side. As described above, the separation roller 21 includes a torque limiter and is applied with torque serving as a resistance force in the direction opposite to the sheet S conveyance direction. This torque is set to cause the separation roller 21 to be driven by the feed roller 16 when one sheet S is at the separation nip portion, or to be stopped when two recording materials S enter the separation nip portion. Accordingly, the separation nip portion enables the sheets S to be conveyed one by one to the downstream side. Subsequently, the sheet S is conveyed to the registration roller 110 by the rotations of the pickup roller 15 and the feed roller 16.

Figure 3A:
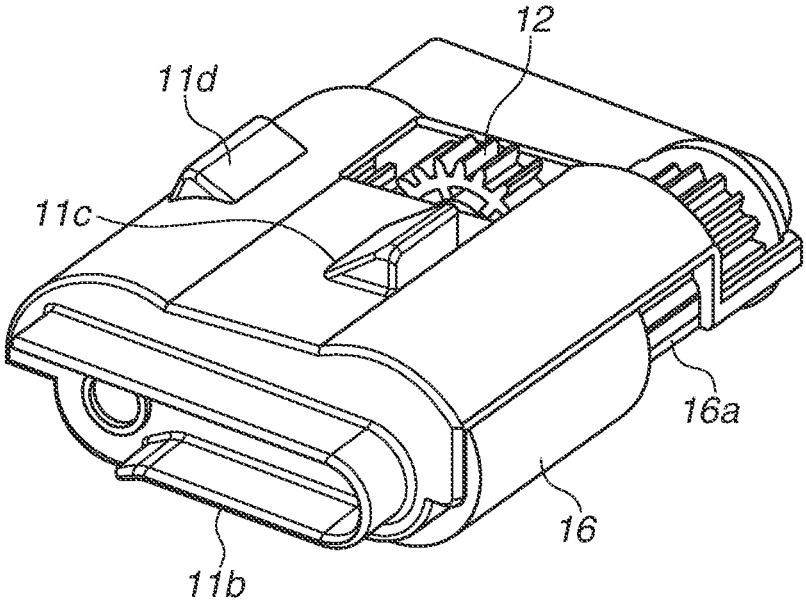
FIG. 3A is a perspective view schematically illustrating the feeding unit viewed from the top.

The feeding unit 10 will be described below with reference to FIGS. 2A, 2B, 3A and 3B. FIG. 3A is a perspective view schematically illustrating the feeding unit 10 when viewed from the top, and FIG. 3B is a perspective view schematically illustrating the feeding unit 10 when viewed from the bottom.

Figure 3B:
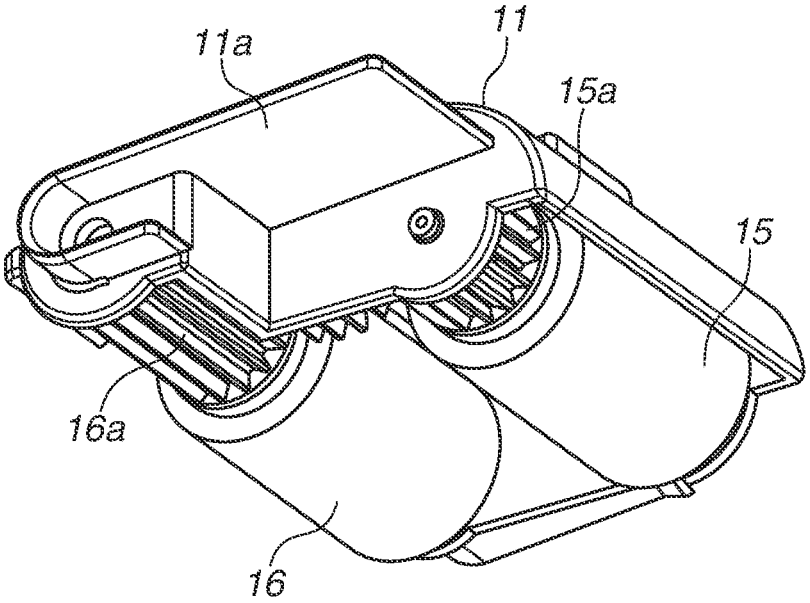
FIG. 3B is a perspective view schematically illustrating the feeding unit viewed from the bottom.

As illustrated in FIGS. 3A and 3B, the feeding unit 10 includes the pickup roller 15, the feed roller 16, the roller holder 11 as a support member, and the idler gear 12. The pickup roller 15 and the feed roller 16 include gears 15*a* and 16*a*, respectively, and the gears 15*a* and 16*a* of the respective rollers are connected with each other via the idler gear 12. This idler gear 12 is also rotatably supported by the roller holder 11. The pickup roller 15 as a first conveyance rotating body and the feed roller 16 as a second conveyance rotating body are rotatably supported by the roller holder 11.

In a state where the feeding unit 10 is attached to the sheet feeding apparatus 30, the driven gear 16*a* as a driven transmission member of the feed roller 16 can be engaged with an input gear 17 as a drive transmission member (described below) at a position different from the position where the driven gear 16*a* engages with the idler gear 12 in the rotation axial direction. Upon reception of the rotational drive from the input gear 17, the feed roller 16 and the pickup roller 15 are driven in an associated way.

The shape of the roller holder 11 will be described below. The roller holder 11 has slit portions 11*a* and 11*b*, a protruding portion 11*c*, and a contact portion 11*d*. Each of the slit portions 11*a* and 11*b* as guided portions have a rib shape protruding outward from the roller holder 11, to the extent outside the feed roller 16, in the axial direction of the feed roller 16. The slit portions 11*a* and 11*b* are extended from the feed roller 16 toward the pickup roller 15 to form a U-shape in which the end on the side of the pickup roller 15 is open. The slit portions 11*a* and 11*b* have a function of guiding the movement of the feeding unit 10. The protruding portion 11*c* engages with a click claw 18*c* disposed on a support frame 18 (described below) when the feeding unit 10 is attached to the main body of the feeding unit 10. The contact portion 11*d* disposed directly above the pickup roller 15 serves as a surface with which the feeding pressure arm 27 comes into contact. The effects of these shapes will be described in detail below.

Figure 4A:
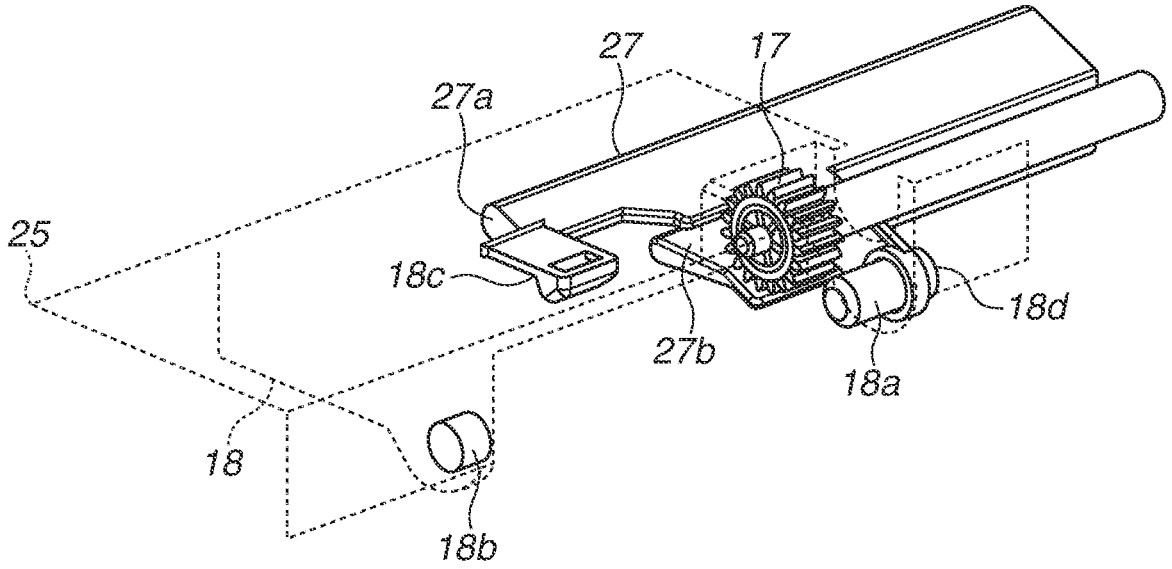
FIG. 4A is a perspective view schematically illustrating a configuration of a feeding support unit in a state where the feeding unit is detached.
Figure 4B:
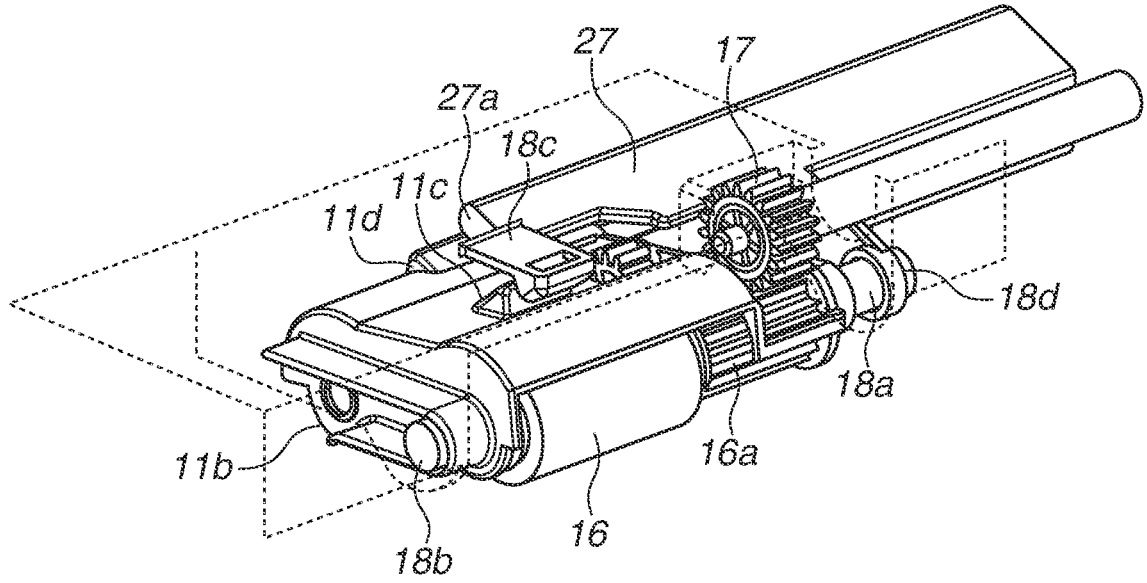
FIG. 4B is a perspective view schematically illustrating the configuration of the feeding support unit in a state where the feeding unit is attached.

The feeding support unit 25 to which the feeding unit 10 is attached will be described below with reference to FIGS. 4A and 4B. FIGS. 4A and 4B are perspective views schematically illustrating a configuration of the feeding support unit 25. FIG. 4A illustrates a state where the feeding unit 10 is detached. FIG. 4B illustrates a state where the feeding unit 10 is detached.

As illustrated in FIGS. 4A and 4B, the feeding support unit 25 includes the support frame 18 as a support member, the input gear 17 as a drive transmission member, and the feeding pressure arm 27 as a pressing member, and is configured to detachably support the feeding unit 10. The support frame 18 has positioning bosses 18*a* and 18*b* as positioning portions on the upstream side of the feeding pressure arm 27. The support frame 18 also has the click claw 18*c* and an arm spindle 18*d*.

The positioning bosses 18*a* and 18*b* as protruding portions protruding toward the inside of the support frame 18 are disposed on the rotational axis of the feed roller 16 in a state where the feeding unit 10 is attached. The positioning bosses 18*a* and 18*b* engage with the slit portions 11*a* and 11*b* of the roller holder 11 to position the feeding unit 10. The click claw 18*c* bends in the attachment process of the feeding unit 10 and engages with the protruding portion 11*c* across a gap when the feeding unit 10 is attached to the sheet feeding apparatus 30. The arm spindle 18*d* is disposed on the same axis as the positioning bosses 18*a* and 18*b*, and rotatably supports the feeding pressure arm 27.

The input gear 17 is rotatably supported by the support frame 18. In a state where the feeding unit 10 is attached to the apparatus body, the input gear 17 engages with the driven gear 16*a* of the feed roller 16 (see FIG. 4B). When the sheet feeding apparatus 30 performs the feeding operation, the input gear 17 rotates by receiving a rotational driving force via a clutch in a feeding drive (not illustrated) and applies a rotational driving force to the driven gear 16*a* of the feed roller 16. More specifically, the input gear 17 is configured to idly rotate when the clutch is disconnected. The feeding pressure arm 27 having a pressing portion 27*a* and a guide portion 27*b* is rotatably supported by the arm spindle 18*d* of the support frame 18.

The feeding pressure arm 27 is connected with the biasing spring 28 (see FIGS. 2A and 2B) at a position (not illustrated) of the feeding pressure arm 27. When the feeding unit 10 is in the contact position, the pressing portion 27*a* is in contact with the contact portion 11*d* of the roller holder 11.

In this state, the pressing portion 27*a* transmits the force of the biasing spring 28 to the sheet S via the pickup roller 15. The guide portion 27*b* engages with the slit portion 11*a* of the roller holder 11 to guide the attachment locus of the feeding unit 10. When the feeding unit 10 is in the separated position, the end of the guide portion 27*b* supports the slit portion 11*a* of the roller holder 11 to hold the feeding unit 10 at the separated position.

Attachment and detachment operations of the feeding unit 10 according to the present exemplary embodiment will be described below. According to the exemplary embodiment, the separation unit 20 is detached first from the sheet feeding apparatus 30 in a state where the door 115A is open. FIGS. 5A, 5B, 6A, and 6B are perspective views illustrating detachment processes of the separation unit 20 and the feeding unit 10. While FIGS. 5A, 5B, 6A, and 6B schematically illustrate a state where the door 115A is separated from the printer 100, the door 115A opens and closes with respect to the printer 100 while being supported by the printer 100.

Figure 5A:
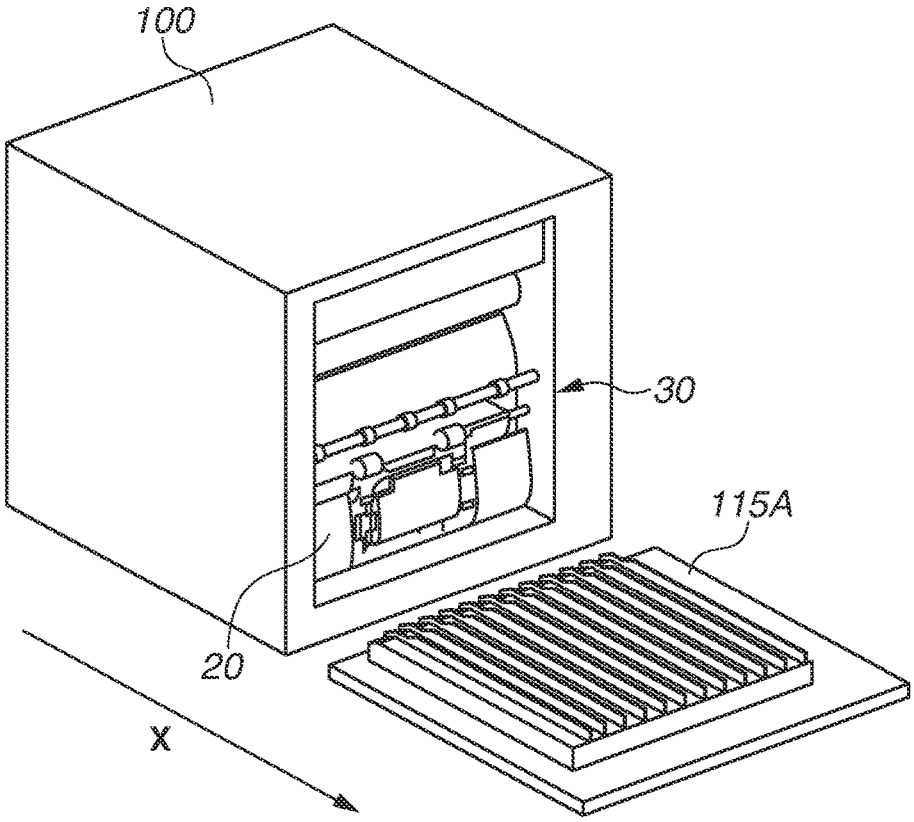
FIGS. 5A and 5B are perspective views illustrating a detachment process of a separation unit.
Figure 5B:
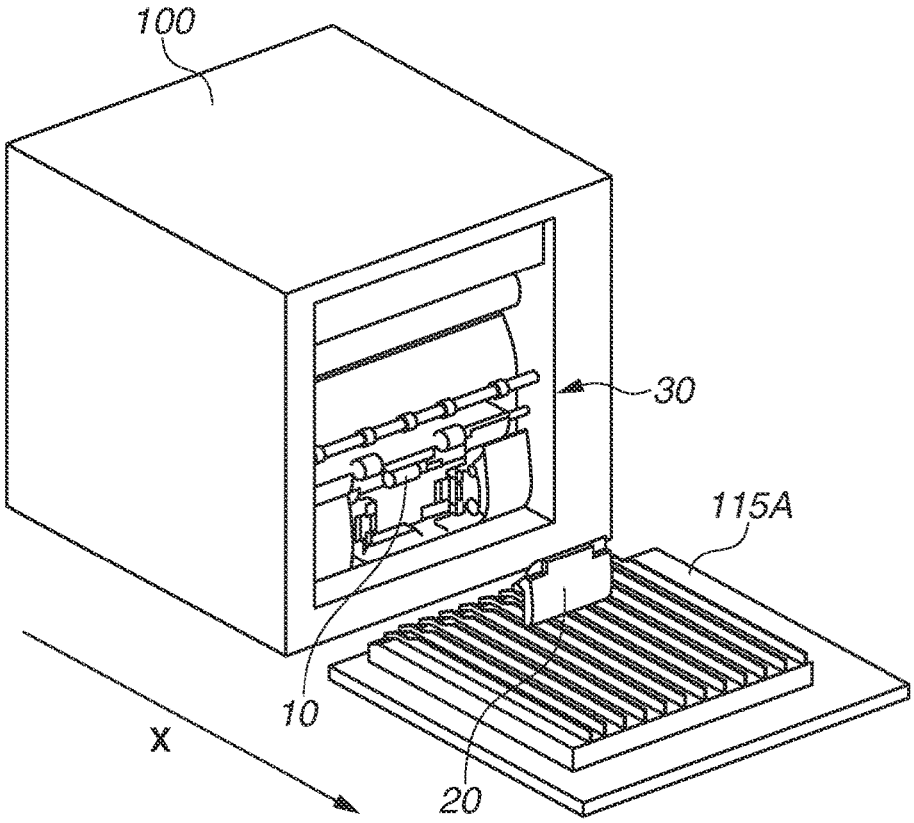
Figure 6A:
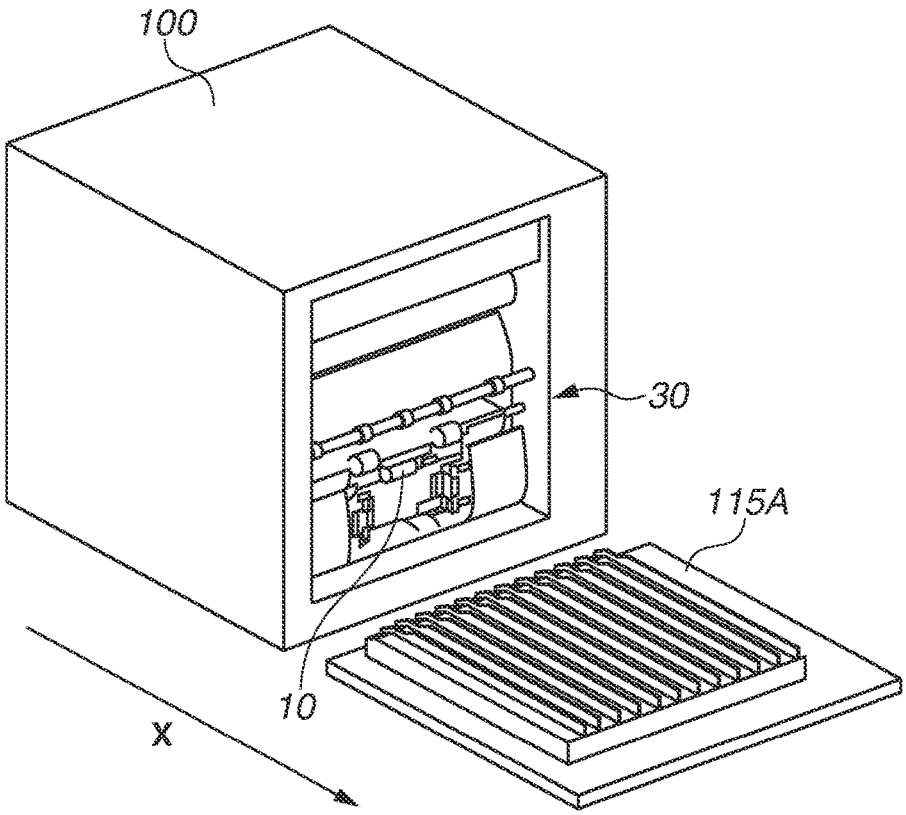
FIGS. 6A and 6B are perspective views illustrating a detachment process of the feeding unit.
Figure 6B:
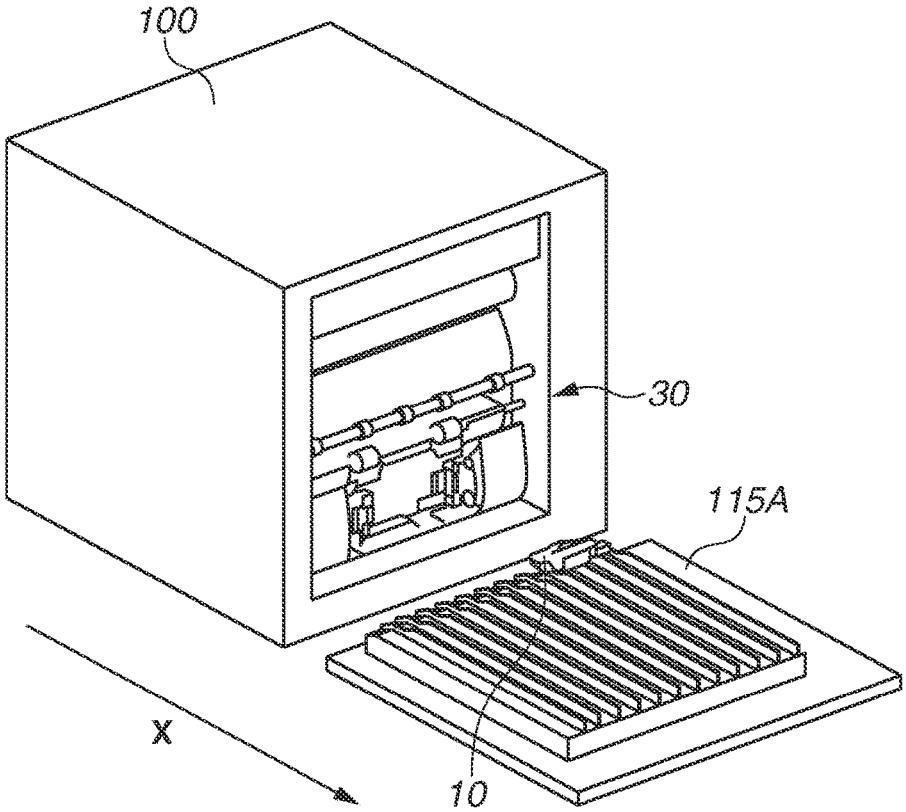

As illustrated in FIG. 5A, when the user opens the door 115A, the separation unit 20 is exposed. In this state, the user detaches the separation unit 20 in the direction of the arrow X. The direction of the arrow X refers to the detachment direction of the separation unit 20. As a result of detaching the separation unit 20, the feeding unit 10 is exposed. Then, in a state illustrated in FIG. 6A, the feeding unit 10 can be detached in the direction of the arrow X as illustrated in FIG. 6B.

Figure 7A:
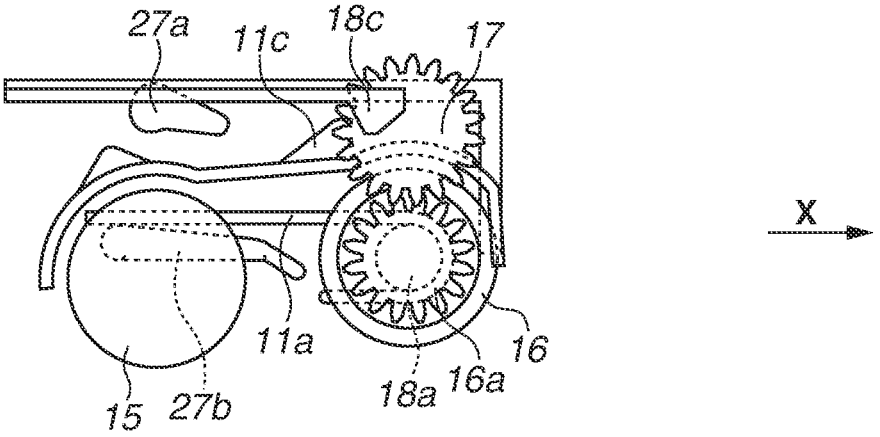
FIGS. 7A, 7B, and 7C are cross-sectional views schematically illustrating attachment and detachment operations of the feeding unit.
Figure 7B:
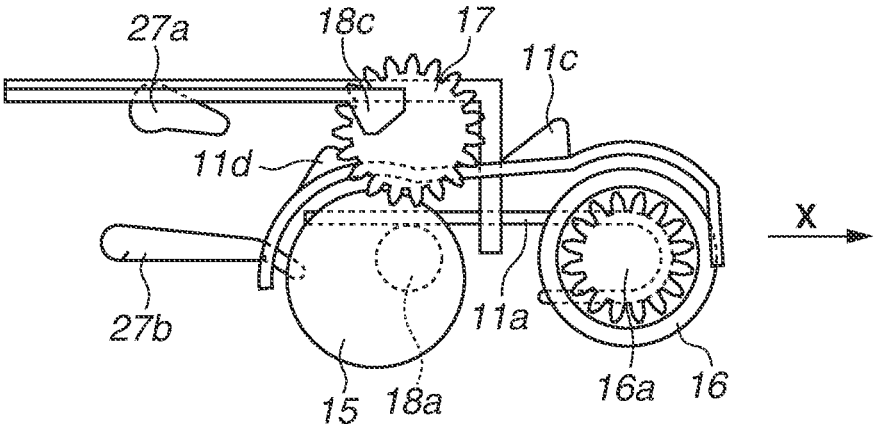
Figure 7C:
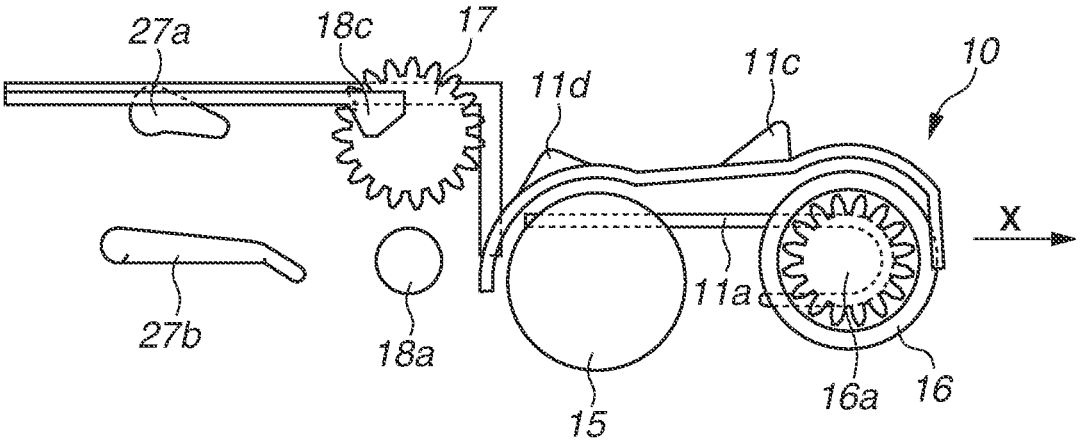

FIGS. 7A to 7C are cross-sectional views schematically illustrating attachment and detachment operations for the feeding unit 10. FIG. 7A illustrates the attached state of the feeding unit 10, and FIGS. 7B and 7C illustrate the process of detaching the feeding unit 10 from the feeding support unit 25.

As described above, the feeding unit 10 is separated from the sheet S when the feeding operation is not performed. As illustrated in FIGS. 7A to 7C, the feed roller 16 and the pickup roller 15 are supported in an approximately horizontal state. In the separated state, the pressing portion 27*a* of the feeding pressure arm 27 is separated from the contact portion of the roller holder 11. In the feeding unit 10, the inner surface of the slit portion 11*a* of the roller holder 11 is supported by the guide portion 27*b* of the feeding pressure arm 27. The user grips any part of the feeding unit 10 and then draws the feeding unit 10 in the direction X illustrated in FIGS. 7A to 7C. In the attached state of the feeding unit 10, the click claw 18*c* disposed on the support frame 18 engages with the protruding portion 11*c* of the roller holder 11 across a space. When the user draws the feeding unit 10, the feeding unit 10 is drawn while the protruding portion 11*c* upwardly bends the click claw 18*c* illustrated in FIGS. 7A to 7C.

In the attached state, the input gear 17 disposed on the side of the support frame 18 engages with the driven gear 16*a* of the feed roller 16, as illustrated in FIG. 7A. As illustrated in FIG. 7A, the input gear 17 directly above the feed roller 16 is disposed at a position where the input gear 17 does not overlap with the direction X for detachment of the feeding unit 10.

Disposing the input gear 17 in this way enables the operator to linearly draw the feeding unit 10 in the direction X.

Further, the input gear 17 connected with the clutch as described above is configured to idly rotate in a non-driven state. Therefore, when the feeding unit 10 is detached, the input gear 17 can idly rotate in the counterclockwise direction illustrated in FIGS. 7A to 7C, and therefore does not disturb the detachment of the feeding unit 10.

Meanwhile, the feeding unit 10 is attached in the reverse locus of the above-described detachment operation. Firstly, the user grips any part of the feeding unit 10 and, while adjusting the slit portions 11*a* and 11*b* at both ends of the roller holder 11 to the upper portions of the positioning bosses 18*a* and 18*b* of the feeding unit 10, pushes the feeding unit 10 leftward in FIGS. 7A to 7C (see FIG. 7B). In this pushing process, the feeding unit 10 is guided by the positioning bosses 18*a* and 18*b* and the guide portion 27*b* of the feeding pressure arm 27 and led to the attachment completion position.

Then, the user pushes the feeding unit 10 while the click claw 18*c* of the support frame 18 is upwardly bended. When the feeding unit 10 is pushed until the bending of the click claw 18*c* is released, the attachment of the feeding unit 10 is completed. This click claw 18*c* enables the user to intuitively recognize the completion of the attachment operation. The input gear 17 engages with the driven gear 16*a* of the feed roller 16 in the attachment locus of the feeding unit 10. However, since the input gear 17 idly rotates like in the detachment operation, the input gear 17 does not disturb the operation for attaching the feeding unit 10 by the user.

According to the present exemplary embodiment, the user can attach and detach the feeding unit 10 only in a linear operation when detaching and attaching the feeding unit 10. More specifically, the user can detach the feeding unit 10 simply by gripping and drawing the feeding unit 10, and attach the feeding unit 10 simply by gripping the feeding unit 10 and pushing the feeding unit 10 in one direction.

A positioning configuration at the feeding timing of the feeding unit 10 will be described below. In the above-described attachment operation, the operator only performs an operation for pushing the feeding unit 10, and the click claw 18*c* and the feeding unit 10 are disposed across a space. Therefore, the positioning to the support frame 18 of the feeding unit 10 is not completed in a state where the feeding unit 10 is only pushed in. More specifically, the feeding unit 10 is approximately attached to the support frame 18. The positional accuracy of the feed roller 16 with respect to the sheet feeding apparatus 30 is an important factor that influences the feeding performance. The feeding unit 10 needs to be accurately positioned during the feeding operation of the sheet feeding apparatus 30.

Figure 8A:
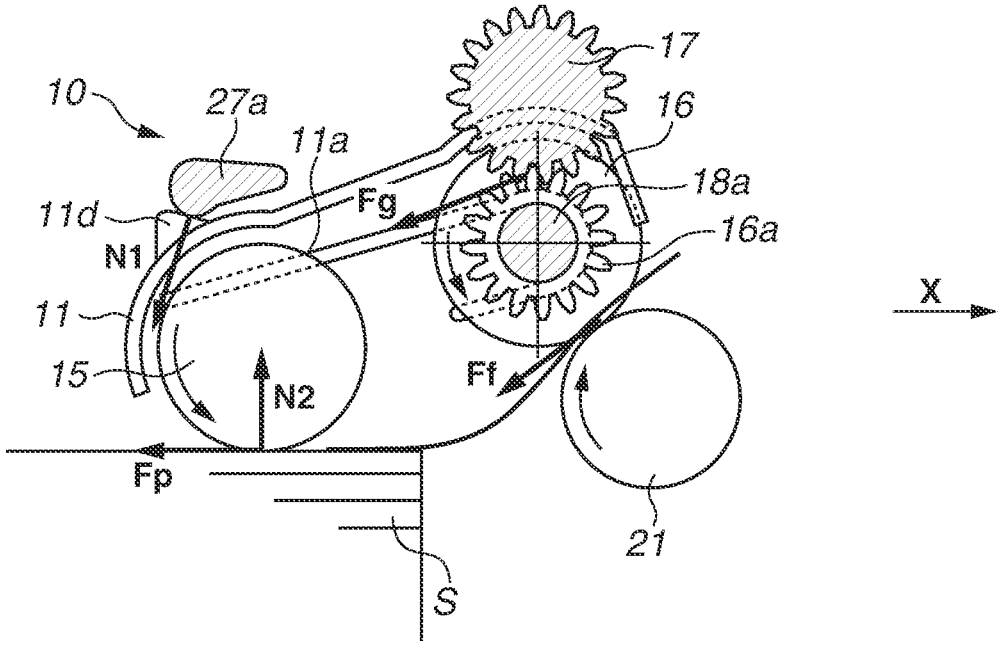
FIGS. 8A and 8B are cross-sectional views schematically illustrating forces applied to the feeding unit in a feeding state.
Figure 8B:
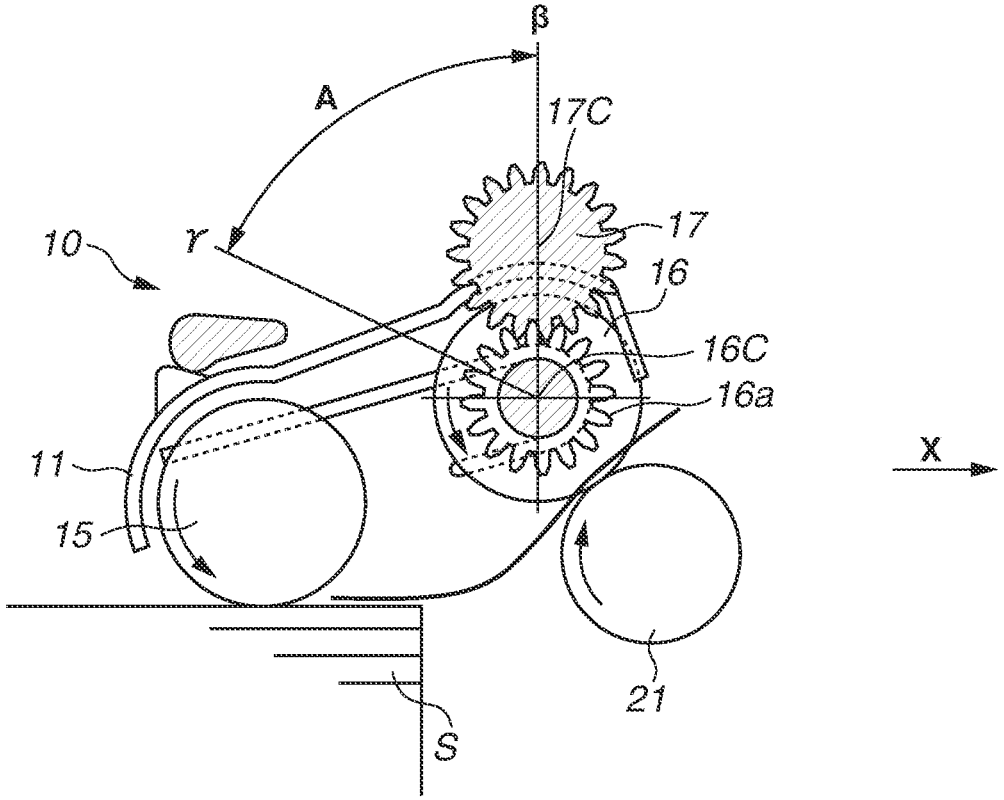

FIGS. 8A and 8B are cross-sectional views schematically illustrating a force applied to the feeding unit 10 in the feeding state. When the sheet feeding apparatus 30 performs the feeding operation, the feeding unit 10 is applied with five different forces: Force N1 applied to the roller holder 11 by the feeding pressure arm 27, Reaction force N2 of the feeding pressure applied by the sheet S, Frictional force Fp applied to the surface of the pickup roller 15, Frictional force Ff applied to the surface of the feed roller 16, and Driving force Fg applied by the input gear 17.

The force N1 from the feeding pressure arm 27 acts on the contact portion 11*d* of the roller holder 11 in the direction of the normal of the contact portion 11*d*. The force N1 of the biasing spring 28 is transmitted to the roller holder 11 via the feeding pressure arm 27 and reaches the sheet S as a feeding pressure via the pickup roller 15. According to the exemplary embodiment, the contact portion 11*d* of the roller holder 11 is inclined in the direction X with respect to the horizontal direction. In this way, the force from the feeding pressure arm 27 is transmitted to the feeding unit 10 in a direction opposite to the direction X for detachment of the feeding unit 10, thus preventing the feeding unit 10 from being ejected in the direction X during the feeding operation.

The reaction force N2 of the feeding pressure applied by the sheet S is transmitted from the sheet S to the pickup roller 15 as a reaction force of the force N1. The frictional force Fp applied to the surface of the pickup roller 15 is the frictional force between the sheet S and the pickup roller 15. The frictional force Fp acts on the surface of the pickup roller 15 in the direction opposite to the conveyance direction of the sheet S.

The frictional force Ff applied to the surface of the feed roller 16 acts on the surface of the feed roller 16. The frictional force Ff includes the frictional force between the sheet S and the feed roller 16 and the force for rotating the separation roller 21. The driving force Fg from the input gear 17 is the force acting on the driven gear 16*a* of the feed roller 16 from the input gear 17 to drive the pickup roller 15 and the feed roller 16 applied with the frictional forces Fp and Ff, respectively.

As illustrated in FIG. 8A, according to the exemplary embodiment, the combined force of the forces N1, Fp, Ff, and Fg, and N1 and N2 acts in the direction opposite to the direction X. More specifically, while the sheet feeding apparatus 30 is performing the feeding operation, the feeding unit 10 is applied with a force that draws the feeding unit 10 in the direction of attachment, i.e., the direction opposite to the direction X to sheet feeding apparatus 30. As a result, the positioning bosses 18*a* and 18*b* come into contact with the ends of the slit portions 11*a* and 11*b* of the roller holder 11, respectively, and the position of the feeding unit 10 in the direction X is determined.

The slit portions 11*a* and 11*b* of the roller holder 11 for positioning the feeding unit 10 are disposed at both axial ends of the feeding unit 10. More specifically, as illustrated in FIG. 3B, the slit portion 11*a* is disposed outside the driven gear 16*a*. The above-described configuration enables the positioning bosses 18*a* and 18*b* at both ends to precisely come into contact with the slit portions 11*a* and 11*b*, respectively, during the feeding operation.

The positional relation between the input gear 17 and the driven gear 16*a* of the feed roller 16 will be described below. As described above, according to the present disclosure, the position where the input gear 17 engages with the driven gear 16*a* of the feed roller 16 is axially deviated from the position where the idler gear 12 engages with the driven gear 16*a*. The above-described configuration enables preventing the idler gear 12 and the input gear 17 from coming into contact with each other when the feeding unit 10 is in the separated position or when the feeding unit 10 is detached. Further, since the input gear 17 is disposed at a position that does not overlap with the attachment locus of the feeding unit 10, the feeding unit 10 can be linearly attached and detached.

As described above, the rotation driving force of the input gear 17 is transmitted to the driven gear 16*a* of the feed roller 16, and the rotation driving force acts in a direction for moving the feeding unit 10 opposite to the direction X. To satisfy the foregoing, the center position of the input gear 17 is within a region (region A illustrated in FIG. 8B) from the upright direction of the rotational axis of the feed roller 16 (see FIGS. 8A and 8B) to the position where the pressure angle direction at the position where the input gear 17 engages with the driven gear 16*a* is oriented downward in FIG. 1.

The region A will be specifically described below with reference to FIG. 8B. In the state where the driven gear 16*a* is applied with a force in the direction opposite to the direction X from the tooth plane of the input gear 17, a virtual line β is a line starting from a rotation center 16C of the driven gear 16*a* and extending in the direction perpendicular to the direction X from the rotation center 16C of the driven gear 16*a*. According to the present exemplary embodiment, the virtual line β passes through the rotational axis 17C at the rotation center of the input gear 17.

The region A is the region defined from the virtual line β to the position (position of a virtual line γ) where the force applied to the driven gear 16*a* by the tooth plane of the input gear 17 acts in the direction perpendicular to the direction X at the pitch point between the input gear 17 and the driven gear 16*a*. By disposing the rotational axis 17C (first rotational axis) of the input gear 17 within the range of the region A, the rotation driving force of the input gear 17 is transmitted to the driven gear 16*a* of the feed roller 16, and acts in the direction for moving the feeding unit 10 in the direction opposite to the direction X.

The feeding unit 10 is also applied with the frictional forces applied to the surfaces of the pickup roller 15 and the feed roller 16, and the frictional forces are also oriented to the attachment direction. However, even when these frictional forces are absent, the feeding unit 10 can be brought into contact with the attachment position because of sufficient idling torque of the feed roller 16 and the pickup roller 15.

As described above, the feeding unit 10 according to the present exemplary embodiment inputs a driving force by using the gears. Therefore, the input gear 17 on the apparatus body is disposed at a position that does not overlap with the attachment locus of the feeding unit 10. By disposing the center position of the input gear 17 at the position where the feeding unit 10 is drawn at the time of feeding, the feeding unit 10 can be linearly attached and detached. Further, in the stage where the feeding unit 10 is attached to the feeding support unit 25, positioning of the feeding unit 10 does not need to be completed. According to the present exemplary embodiment, the feeding unit 10 does not complete positioning even in a state where the door 115A that has been opened for replacement is closed.

At the timing when the feeding unit 10 is detached from the feeding support unit 25, the feeding unit 10 is roughly attached to the feeding support unit 25. Thus, the present exemplary embodiment provides favorable usability in detaching the feeding unit 10. Since the drawing action of the input gear 17 is used for the positioning of the feeding unit 10 at the time of sheet feeding, a locking unit and a retaining mechanism can be eliminated.

The present exemplary embodiment has been described above centering on a configuration in which the feeding unit 10 supports both the pickup roller 15 and the feed roller 16. However, the feeding unit 10 may have either one conveyance rotating body. For example, the feeding unit 10 may be an attaching/detaching unit supporting only the pickup roller 15.

Figure 9:
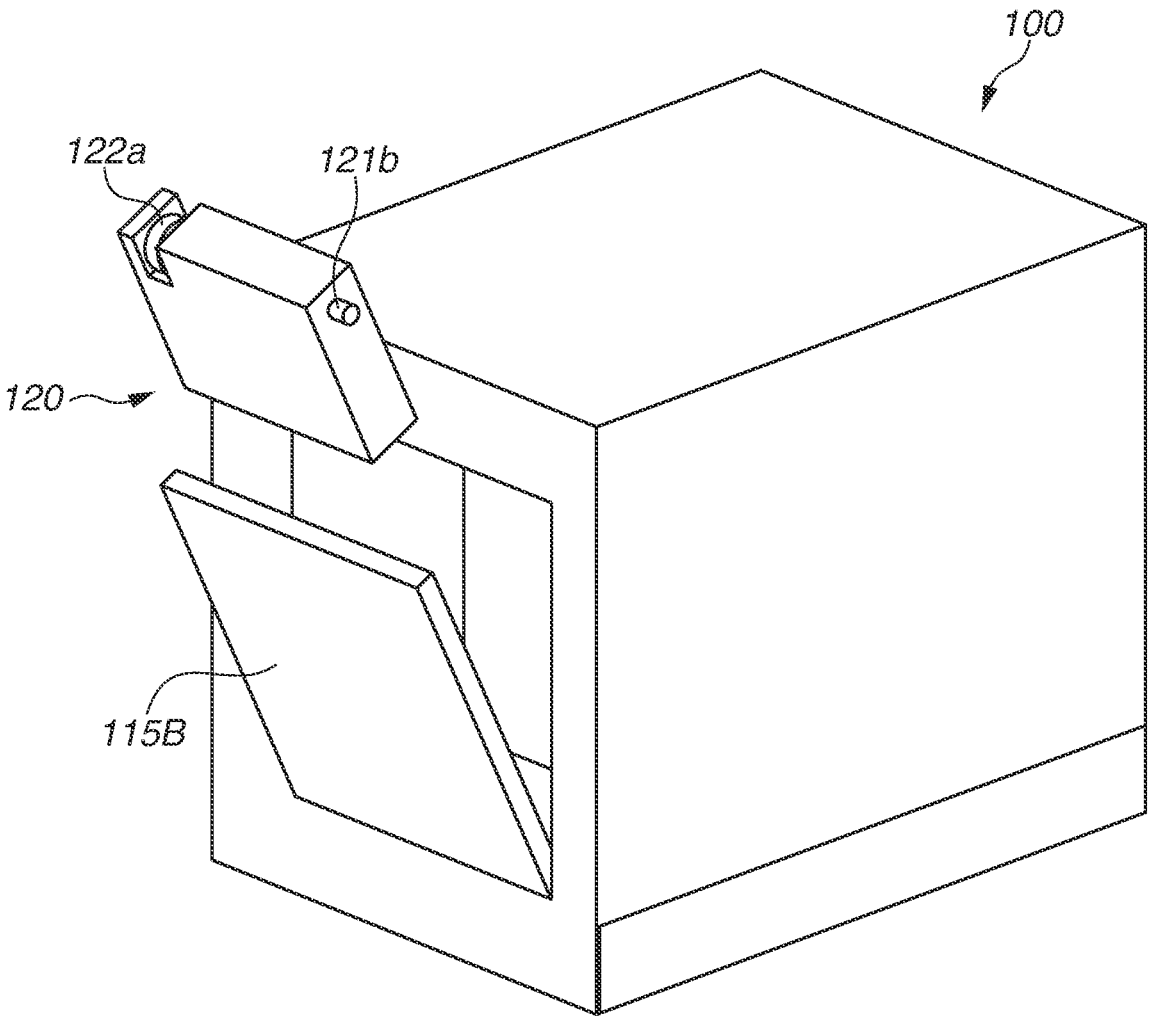
FIG. 9 is a perspective view schematically illustrating an arrangement of a collected toner container according to a second exemplary embodiment disclosure.
Figure 10:
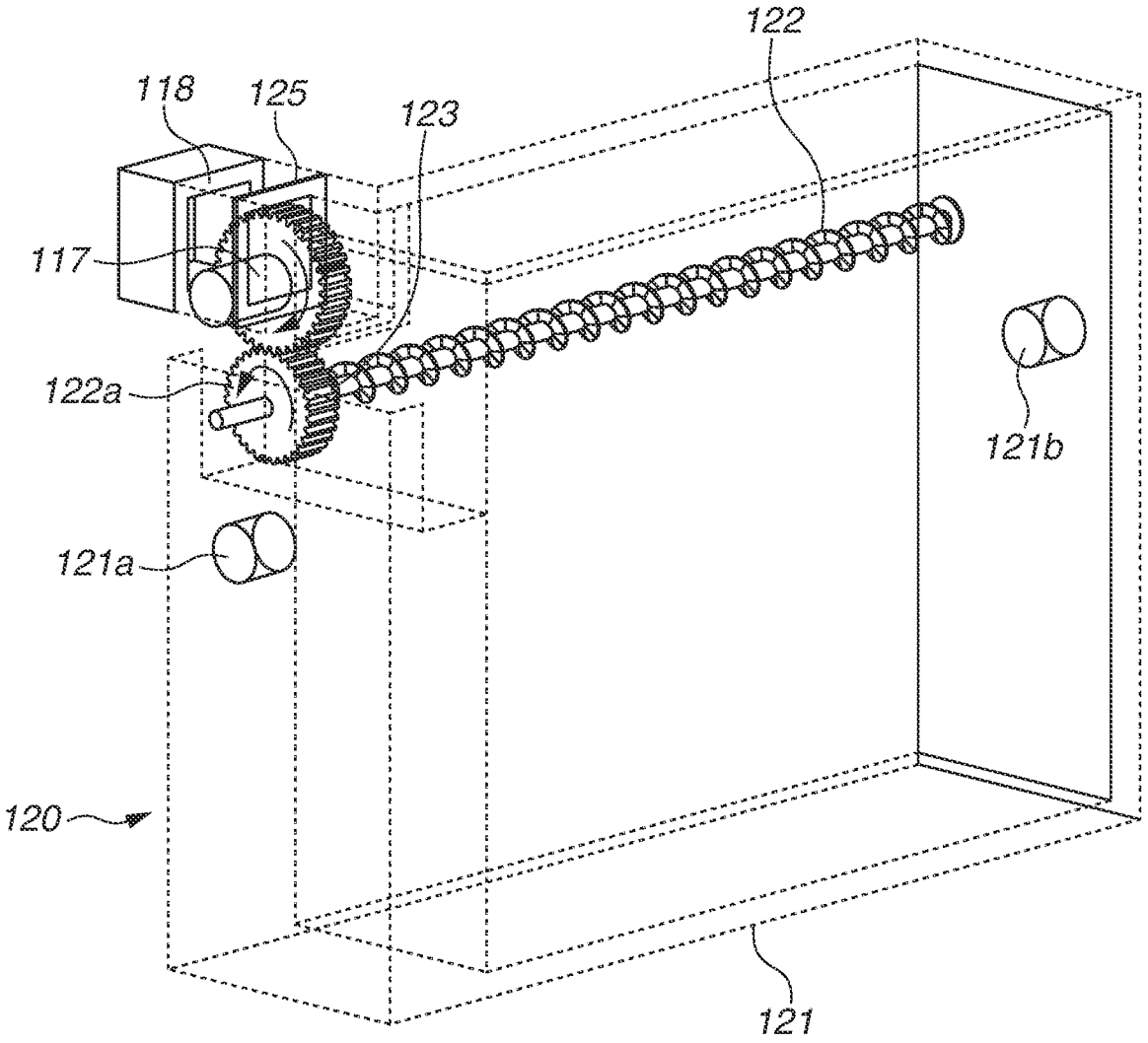
FIG. 10 is a perspective view schematically illustrating a configuration and a drive configuration of the collected toner container according to the second exemplary embodiment disclosure.
Figure 11:
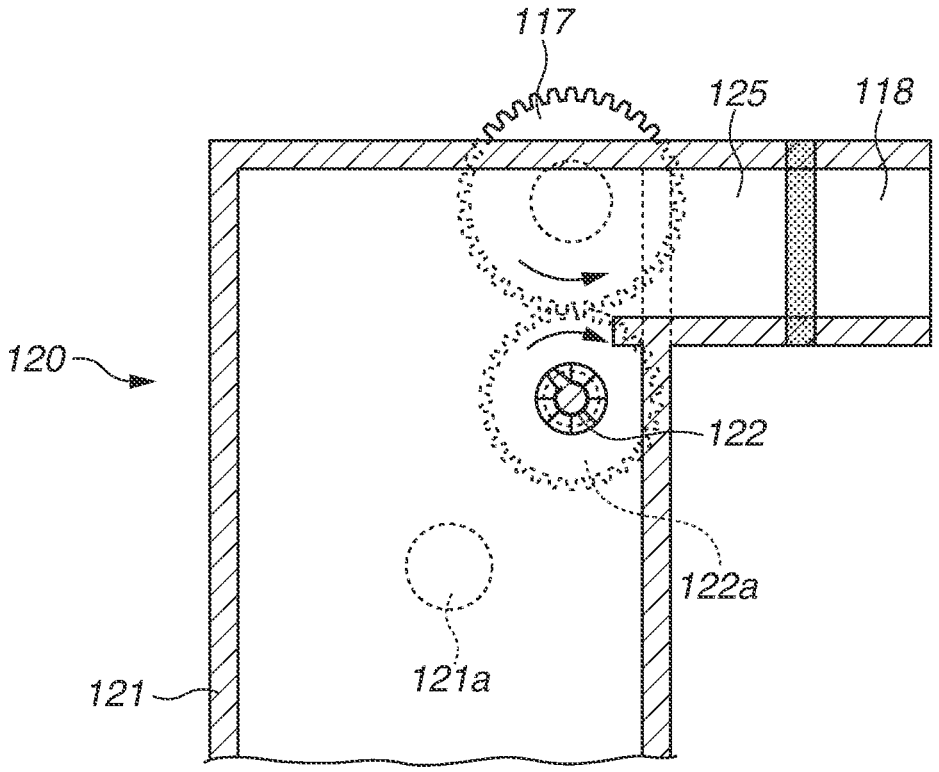
FIG. 11 is a cross-sectional view schematically illustrating a relation between an input gear, a conveyance screw, and a toner reception slot according to the second exemplary embodiment disclosure.

The first exemplary embodiment has been described above centering on the feeding unit 10 as an attaching/detaching unit. According to a second present exemplary embodiment, an example where a collected toner container 120 is applied as an attaching/detaching unit will be described below with reference to FIGS. 9 to 11. FIG. 9 is a perspective view schematically illustrating an arrangement of the collected toner container 120 according to the present exemplary embodiment. FIG. 10 is a perspective view schematically illustrating a configuration and a drive configuration of the collected toner container 120. FIG. 11 is a cross-sectional view schematically illustrating a relation between the input gear 117, a conveyance screw 122, and a toner reception slot 125. Configurations similar to those according to the first exemplary embodiment are assigned the same reference numerals, and redundant descriptions thereof will be omitted.

The arrangement of the collected toner container 120 according to the present exemplary embodiment will be described below with reference to FIG. 9. The collected toner container 120 is attached to the inside of the door 115B disposed on the side surface of the printer 100, as illustrated in FIG. 9. To replace the collected toner container 120, the user opens the door 115B, detaches the used collected toner container 120, and then inserts a new collected toner container 120. Then, the user closes the door 115B to complete the replacement. When the user closes the door 115B, the collected toner container 120 rotates about the fulcrum of the door 115B and is guided to the attachment position.

The configuration of the collected toner container 120 will be described below with reference to FIGS. 10 and 11. The collected toner container 120 includes a container body 121, the conveyance screw 122 as a rotating body, and the toner reception slot 125. As illustrated in FIG. 10, the conveyance screw 122 is rotatably supported by the container body 121, and a bearing seal member 123 is disposed in the vicinity of the bearing. The toner reception slot 125 is disposed in the vicinity of the conveyance screw 122 on the surface opposite to the door 115B of the container body 121. The toner reception slot 125 faces a toner discharge port 118 of an apparatus body of the printer 100. As illustrated in FIG. 11, a seal member 124 for filling the gap is disposed on the surface of the toner reception slot 125 facing the toner discharge port 118 of the apparatus body of the printer 100. This seal member 124 is formed of an expandable elastic material. When the openings are close to each other, the seal member 124 is compressed to prevent leakage of toner.

Toner collected by an intermediate transfer belt cleaner is conveyed to the inside of the collected toner container 120 via the toner discharge port 118 of the printer 100. Then, the collected toner is conveyed by the conveyance screw 122 and uniformly stored in the collected toner container 120.

The drive configuration of the conveyance screw 122 according to the present exemplary embodiment will be described below. As illustrated in FIGS. 10 and 11, the conveyance screw 122 is disposed on the same axis as a driven gear 122*a* as a driven transmission member. In a state where the collected toner container 120 is attached to the apparatus body of the printer 100, the driven gear 122*a* engages with the input gear 117 as a drive transmission member on the printer 100. According to the exemplary embodiment, when the user sets the collected toner container 120 and closes the door 115B, the input gear 117 engages with the driven gear 122*a*. More specifically, the rotation fulcrum of the door 115B is set at a position where the movement locus of the collected toner container 120 does not interfere the input gear 117. In other words, the driven gear 122*a* of the conveyance screw 122 is configured not to come close to the input gear 117 during the operation for opening the door 115B. The rotational direction of the input gear 117 overlaps with the direction for moving the collected toner container 120 to the side opposite to the door 115B.

A method for positioning the collected toner container 120 will be described below. As illustrated in FIG. 10, guided portions 121*a* and 121*b* of the collected toner container 120 are bosses and disposed at both ends of the collected toner container 120 in the axial direction of the conveyance screw 122. By disposing the guided portions 121*a* and 121*b* outside the driven gear 122*a* of the conveyance screw 122 in this way, the guided portions 121*a* and 121*b* can be reliably brought into contact with the positioning portions on the apparatus body, as described in the first exemplary embodiment. According to the exemplary embodiment, the position of the rotational axis of the input gear 117 with respect to the rotational axis of the driven gear 122*a* is disposed within the region A described above with reference to FIGS. 8A and 8B according the first exemplary embodiment, as illustrated in FIG. 11.

The toner reception slot 125 is also disposed on the surface opposite to the door 115. Therefore, when the conveyance screw 122 receives a driving force from the input gear 117, the toner reception slot 125 comes close to the toner discharge port 118 on the apparatus body. This movement brings the guided portions 121*a* and 121*b* into contact with the positioning portions on the apparatus body, compresses the seal member 124, and fills the gap between the toner discharge port 118 and the toner reception slot 125, and therefore favorable sealing characteristics can be achieved.

As described above, the bearing seal member 123 is disposed in the vicinity of the bearing of the conveyance screw 122. The bearing seal member 123 is disposed being axially and circumferentially compressed in the attached state, and therefore the sealing characteristics is enhanced and the driving torque of the conveyance screw 122 is increased. Increasing the driving torque of the conveyance screw 122 in this way increases the forces applied to the collected toner container 120 by the input gear 117. More specifically, the contact force to the guided portions 121*a* and 121*b* can be increased by increasing the driving torque of the conveyance screw 122.

By a setting in which a force to the collected toner container 120 is applied in the direction opposite to the detachment direction of the collected toner container 120 during the rotation of the input gear 117, the driving torque of the conveyance screw 122 is increased, the feeding unit 10 can be reliably drawn, and therefore a retaining configuration can be eliminated. More specifically, this configuration improves the usability for unit replacement.

Although the present exemplary embodiment is applied to the collected toner container 120 as an attaching/detaching unit, the present disclosure is not limited thereto but applicable to other attaching/detaching units.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2019-178028, filed Sep. 27, 2019, which is hereby incorporated by reference herein in its entirety.

What is claimed is:

1. A sheet feeding apparatus for feeding a sheet, comprising:

a storage unit, having a stacking member, configured to store sheets stacked on the stacking member;

a feeding unit, attachable to and detachable from a support unit disposed in the sheet feeding apparatus, configured to feed the sheets stacked on the stacking member;

a separation unit configured to separate one by one the sheets fed by the feeding unit; and a drive transmission member configured to rotate about a first rotational axis, wherein the feeding unit includes a driven transmission member configured to engage with the drive transmission member to receive a driving force from the drive transmission member in a state where the feeding unit is attached to the sheet feeding apparatus, a conveyance rotating body configured to convey a sheet, the conveyance rotating body rotating by the driven transmission member receiving the driving force and rotating, and a holding member configured to hold the driven transmission member and the conveyance rotating body, the holding member including a guided portion for movement of the feeding unit with respect to a guide portion on the support unit, wherein the conveyance rotating body is rotatably supported by the holding member, and a second rotational axis at a rotation center of the driven transmission member is disposed at a position different from a position of the first rotational axis, wherein the support unit has a positioning portion for positioning the feeding unit, wherein, when the feeding unit is attached to the sheet feeding apparatus, the drive transmission member engages with the driven transmission member, and wherein when the driving force is transmitted from the drive transmission member to the driven transmission member, the guided portion is positioned by the positioning portion upon contact with the positioning portion using a force in an attachment direction of the feeding unit.

2. The sheet feeding apparatus according to claim 1, wherein the drive transmission member is an input gear disposed on the support unit.

3. The sheet feeding apparatus according to claim 2, wherein the driven transmission member is a driven gear configured to engage with the input gear, and wherein the input gear (the drive transmission member) is configured to idly rotate in a state where the driving force is not transmitted to the driven gear (the driven transmission member).

4. The sheet feeding apparatus according to claim 3, wherein the support unit rotatably supports a pressing member having a pressing portion for pressing the guided portion from the outside and the guide portion for supporting the guided portion from the inside.

5. The sheet feeding apparatus according to claim 4, wherein the positioning portion for guiding the guided portion toward the pressing member on an upstream side of the pressing member in the attachment direction of the feeding unit.

6. The sheet feeding apparatus according to claim 5, wherein, in a state where the driving force is transmitted from the drive transmission member to the driven transmission member, the feeding unit is positioned with respect to the sheet feeding apparatus by the guided portion receiving a force in the attachment direction of the feeding unit and coming into contact with the positioning portion.

7. The sheet feeding apparatus according to claim 3, wherein, the first rotational axis is disposed within a region defined by a virtual line that starts at the second rotational axis of the driven gear and extends in a direction perpendicular to the attachment direction, to a position where the driving force applied to the driven gear by a tooth plane of the input gear acts in the direction perpendicular to the attachment direction at a pitch point between the driven gear and the input gear.

8. The sheet feeding apparatus according to claim 1, wherein the conveyance rotating body has a first conveyance rotating body that comes in contact with a sheet stacked on the stacking member and conveys the sheet, and a second conveyance rotating body that conveys the sheet conveyed by the first conveyance rotating body to a further downstream side, and wherein, in the feeding unit, the driven transmission member is disposed on a same axis as the second conveyance rotating body.

9. An image forming apparatus comprising:

a storage unit, having a stacking member, configured to store sheets stacked on the stacking member;

a feeding unit, attachable to and detachable from a support unit disposed in the image forming apparatus, configured to feed the sheets stacked on the stacking member;

a separation unit configured to separate one by one the sheets fed by the feeding unit;

a drive transmission member configured to rotate about a first rotational axis; and an image forming unit configured to form an image on the sheet separated by the separation unit, wherein the feeding unit includes a driven transmission member configured to engage with the drive transmission member to receive a driving force from the drive transmission member in a state where the feeding unit is attached to the image forming apparatus, a conveyance rotating body configured to convey a sheet, the conveyance rotating body rotating by the driven transmission member receiving the driving force and rotating, and a holding member configured to support the driven transmission member and the conveyance rotating body, wherein the holding member includes a guided portion for movement of the feeding unit with respect to a guide portion on the support unit, wherein the conveyance rotating body is rotatably supported by the holding member, and a second rotational axis at a rotation center of the driven transmission member is disposed at a position different from a position of the first rotational axis, wherein the support unit has a positioning portion for positioning the feeding unit, wherein, when the feeding unit is attached to the image forming apparatus, the drive transmission member engages with the driven transmission member, and wherein when the driving force is transmitted from the drive transmission member to the driven transmission member, the guided portion is positioned by the positioning portion upon contact with the positioning portion using a force in an attachment direction of the feeding unit.

10. The image forming apparatus according to claim 9, wherein the drive transmission member is an input gear disposed on the support unit.

11. The image forming apparatus according to claim 10, wherein the driven transmission member is a driven gear configured to engage with the input gear, and wherein the input gear is configured to idly rotate in a state where the driving force is not transmitted to the driven gear.

12. The image forming apparatus according to claim 11, wherein the support unit rotatably supports a pressing member having a pressing portion for pressing the guided portion from the outside and the guide portion for supporting the guided portion from the inside.

13. The image forming apparatus according to claim 12, wherein the positioning portion for guiding the guided portion toward the pressing member on an upstream side of the pressing member in the attachment direction of the feeding unit.

14. The image forming apparatus according to claim 13, wherein, in a state where the driving force is transmitted from the drive transmission member to the driven transmission member, the feeding unit is positioned with respect to the image forming apparatus by the guided portion receiving a force in the attachment direction of the feeding unit and coming into contact with the positioning portion.

* * * * *